US006296576B1

(12) United States Patent
Capelli

(10) Patent No.: US 6,296,576 B1
(45) Date of Patent: Oct. 2, 2001

(54) GOLF CLUB HAVING A SWING-WEIGHT HOUSING ALLOWING VARIABLE SWING-WEIGHTS AND AUTOMATIC COUNTERBALANCING

(76) Inventor: Raymond A. Capelli, 253D Columbine Ave., Whiting, NJ (US) 08759

( * ) Notice: Subject to any disclaimer, the term of this patent is extended or adjusted under 35 U.S.C. 154(b) by 0 days.

(21) Appl. No.: 09/347,746

(22) Filed: Jul. 6, 1999

(51) Int. Cl.[7] ..... A63B 53/04; A63B 53/06; A63B 53/08

(52) U.S. Cl. ..... 473/326; 473/333

(58) Field of Search ..... 473/333, 334, 473/326, 349, 316; 273/170

(56) References Cited

U.S. PATENT DOCUMENTS

| | | | | |
|---|---|---|---|---|
| 1,894,841 | * | 1/1933 | Adams | 473/326 |
| 5,251,901 | | 10/1993 | Solheim et al. . | |
| 5,362,055 | | 11/1994 | Rennie . | |
| 5,489,094 | | 2/1996 | Pritchett . | |
| 5,643,107 | | 7/1997 | Gorman . | |
| 5,803,829 | * | 9/1998 | Hayashi | 473/326 |

FOREIGN PATENT DOCUMENTS

| | | | | |
|---|---|---|---|---|
| 448561 | * | 6/1936 | (GB) | 473/326 |

OTHER PUBLICATIONS

Golf Magazine Clubsmarts, Aug. 1998, Your Clubs are Okay p. 70 Buying Golf Clubs That Work Author– Jonathan Abrahams Publisher– Lyons & Burford pp., 22, 23, 24, 25, 34, 35, 84, 85, 86, 87.

* cited by examiner

*Primary Examiner*—Sebastiano Passaniti
*Assistant Examiner*—Sneh Varma

(57) ABSTRACT

Metal wood and wood clubs with a "swing-weight housing" using "variable swing-weights" creating a variable swingweight", an "automatic counterbalancing" effect and "varied center of gravity" effects in addition to an increased trajectory and shot distance to the golf ball when hit. The "swing-weights" are housed in a "swing-weight housing" within the golf club cavity. On address, the club head total weight is the "swing-weights" plus the club head. On the upswing the "swing-weights" travel from the "swing-weight housing" through the hosel cavity, into the hollow shaft, coming to rest in the grip end of the hollow shaft. On the downswing the "swing-weights" reverses its travel to the club head, picking up momentum and slightly increasing club head speed. The velocity of the club head plus the combined weights of the "swing-weights and club head, gives a greater trajectory and shot distance when the ball is hit, since the energy imparted to the ball is proportional to the effective mass of the club head times the square of the club head velocity.

14 Claims, 5 Drawing Sheets

FIG. 1
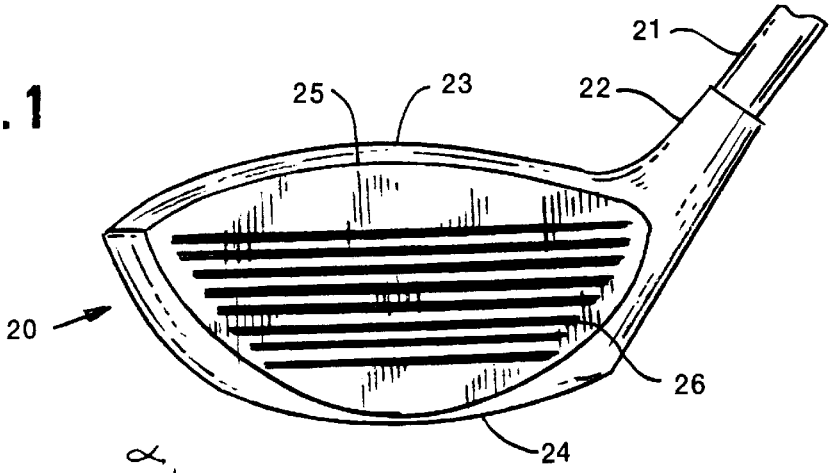
FIG. 2
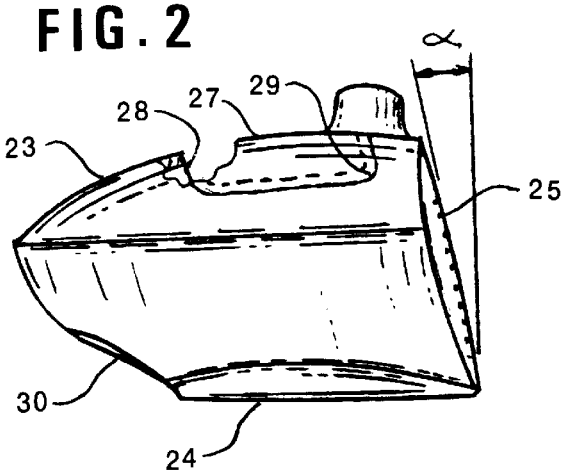
FIG. 4
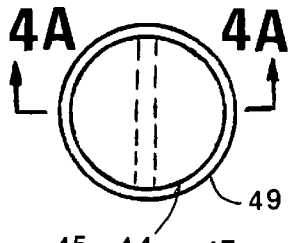
FIG. 4A
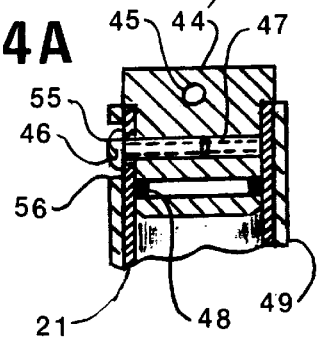
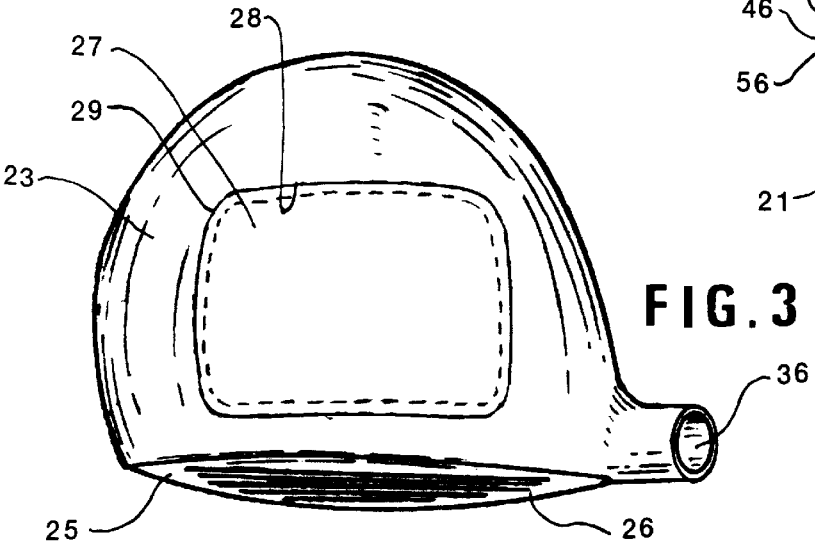
FIG. 3

FIG. 9
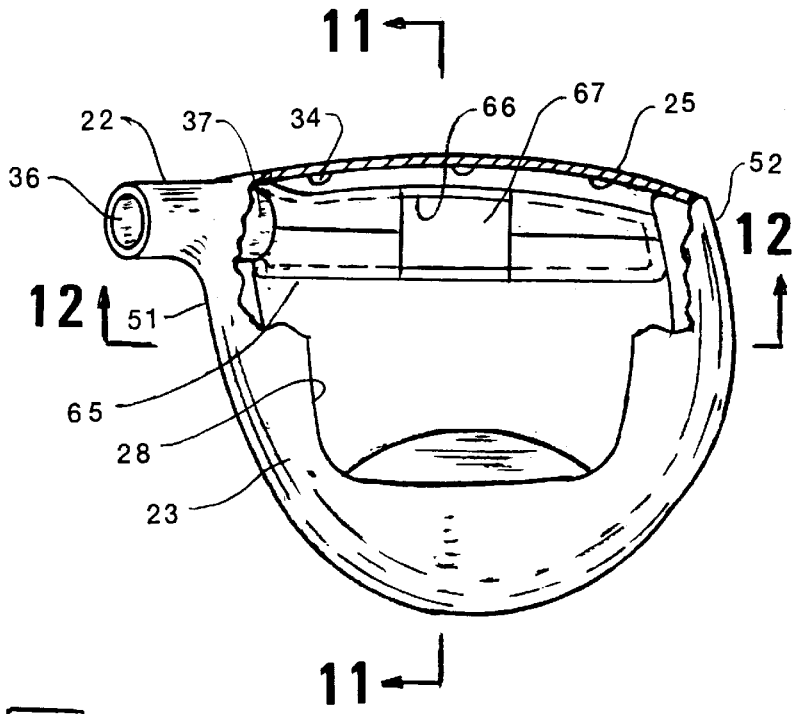
FIG. 11
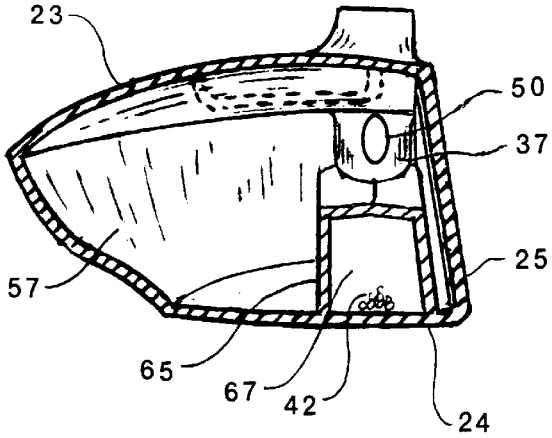
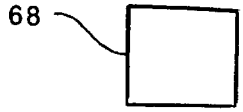
FIG. 10
FIG. 12
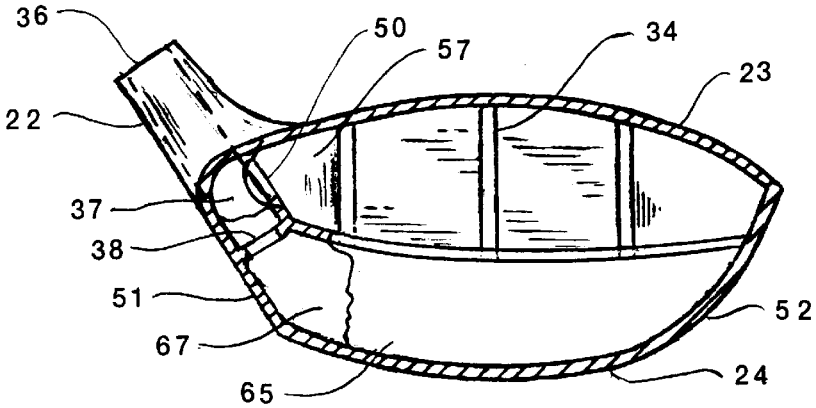

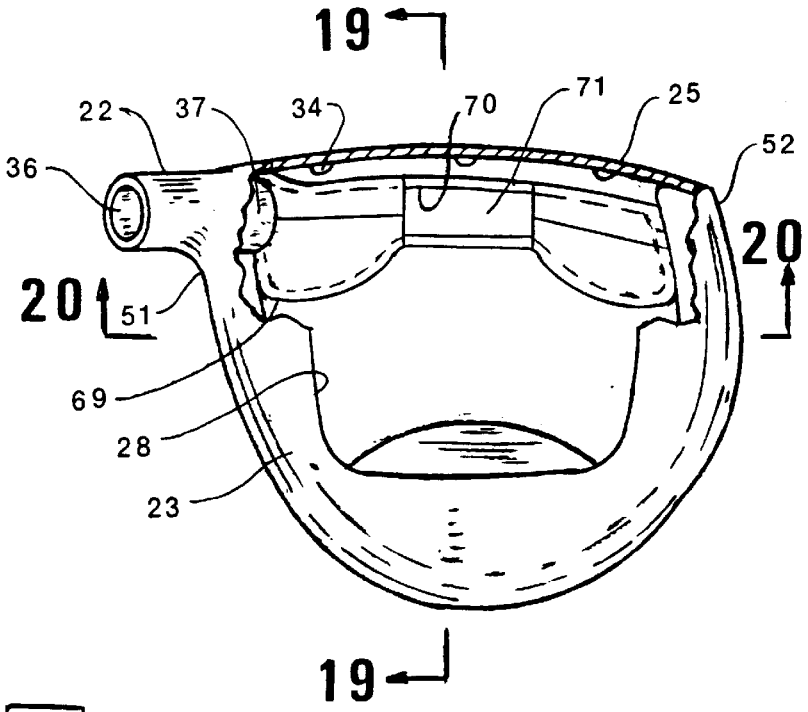
FIG. 17
FIG. 19
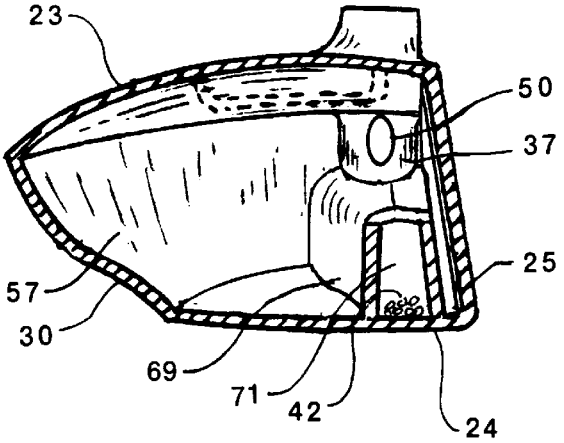
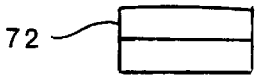
FIG. 18
FIG. 20
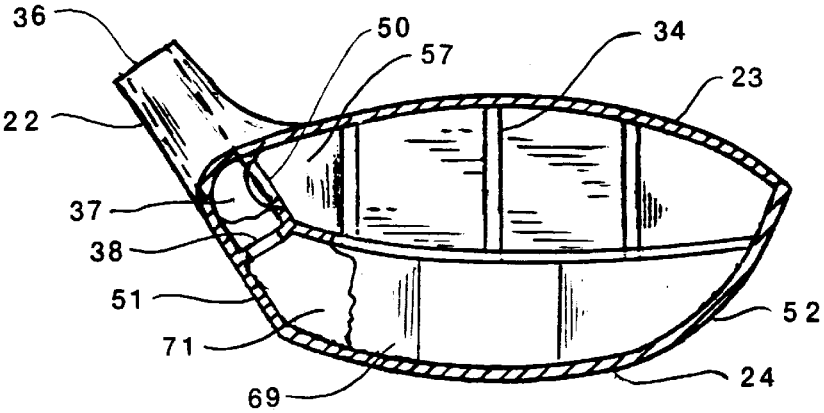

GOLF CLUB HAVING A SWING-WEIGHT HOUSING ALLOWING VARIABLE SWING-WEIGHTS AND AUTOMATIC COUNTERBALANCING

BACKGROUND OF THE INVENTION

1. Field of Invention

This invention relates to the field of golf clubs. More specifically, it relates to an improved club head with a swing-weight housing and variable swing-weights for metal wood and wood wood clubs.

2. Description of Prior Art

Many improvements have been made over the years in the design of golf clubs with the desire to improve one's game and to increase a players competitive advantage. A recent development is that of the metal wood and oversized metal wood, Metal woods began an equipment revolution in the late 1970's embracing a simple concept of perimeter weighting designed, simply put, to make the game easier. Traditionally, woods (clubs usually used for tee shots and longer fairway shots) have had heads made of hard woods such as persimmon or laminated maple. Wood is softer than metal and therefore provides a softer feel at impact. Better players appreciate this because it gives than a feeling that they can work with the ball—deliberately curving the ball to the left or right—because the ball stays on the club face a split second longer. However, the tendency of wood to warp or split, coupled with the increasing cost of material and labor, has led to the development of metal heads for woods. Such metal woods typically comprise a hollow cast metal shell filled with a synthetic plastic foam material.

The metal wood has achieved a large measure of success in terms of acceptance in use by skilled golfers. nevertheless, many golfers still prefer traditional "wooden" woods, because of what they consider to be a non-optimal weight distribution in metal wood heads. Specifically, a very important element of the club head design is the concentration of as much mass of the head as possible into the face of the club in the portion of the head behind the face. (This process is called foreweighting, done to bring the center of gravity forward in the club head, promoting a lower shot trajectory.—Reference,"Clubsmarts", buying golf clubs that work, Author Jonathan Abrahams.) This puts the mass of the head where it effectively contributes to energy imparted to the ball, rather than being merely "dead weight" that limits the velocity of the club head when it is swung. In other words, such a distribution of the mass in the club head increases the total mass. Maximizing the effective mass results in a little or no loss in the achievable club head velocity. The result is a greater shot distance, since the energy imparted to the ball by the club is proportional to the effective mass of the club head times the square of the club head velocity.—Generally this is true, unless the face construction is so rigid and inflexible that some energy is lost because the face deflects less and the ball deforms. (Reference, Golf Magazine, August 1998, page 70).

Preferably the mass in the club head is distributed around the perimeter of the club face. Perimeter weighting gives the club a larger sweet spot. Thus, the perimeter weighted club is more forgiving. That is, a golfer need not strike the ball in the center of the club face to project the ball in a straight path. The enlarged sweet spot of a perimeter weighted club face allows the golfer a larger margin of error when striking the ball. A hit off center still achieves a straight shot.

Recently, metal woods have become larger and oversized metal woods are not very popular. It is desirable to maximize the size of the oversize club head without increasing the weight of the club head to achieve maximum distance and velocity. In producing a larger oversized metal club head, therefore, the walls of the club head are thinner than a normal size club to avoid increasing the weight of the larger club and reducing the swing velocity. With their thinner walls, the oversized metal woods are more susceptible to failure by cracking or crushing, due to the lack of an internal supporting structure. The present invention corrects this.

Normal size and fairway metal woods have a thicker wall section than the oversized metal woods. A thicker wall section increases the club head weight, reducing club head speed, or, swing velocity. Conversely, a thinner wall or lighter weighted club head would increase the club head speed, or swing velocity. The best of both worlds is a desirable feature. Having a much heavier club head while maintaining or increasing club head speed or swing velocity translates into a greater shot distance over the norm, since the energy imparted to the ball by the club is proportional to the effective mass of the club head times the square of the club head velocity.—A feature not available in the present day golf clubs, for the oversized, normal or fairway clubs The present invention corrects this problem.

Counterbalancing is the process of reducing the club's swingweight by adding weight to the grip end. Total weight increases and swingweight decreases. In producing today's golf clubs, no thought has been given to an automatic counterbalancing effect. This problem has been corrected by this invention.

Swingweight refers to the distribution of weight in a golf club. Weight is deposited in the head end and in the grip end of the golf club and the relationship of those weights is the club's swingweight. It has nothing to do with the overall weight. Two clubs may have the same overall weight, but if one of them has a greater ratio of weight in the head, it will feel heavier, and thus have a heavier swingweight. Beginning golfers, women, juniors and seniors prefer swingweights with very little weight in the head (more in the grip) so they feel lightest and it makes it easier to create club head speed. No thought has been given to the present day golf clubs to have a variable swingweight. This problem has been solved and corrected by this invention.

The top of the metal club head in some oversized club heads is so thin that a golfer may crush or crack the metal club head by stepping on the crown. It is also subject to failure by allowing the crown to strike the sole of another club when inserting it into the golf bag. The present invention corrects this problem.

Another disadvantage of the conventional metal wood club heads is that they are molded or cast with an opening in the bottom or sole portion of the club head. A sole plate is welded over the opening to seal the club head. The sole plate weld seam creates a structural discontinuity at the juncture of the front edge of the sole plate and bottom edge of the face plate. This structural discontinuity or weld seam may be subject to failure as the face strikes the ball or the sole strikes the ground. The present invention corrects this problem.

On a practical level, wooden clubheads provide playability that, generally, woods of other materials can't match. However, a disadvantage of the wood wood clubs is that they have the majority of the weight behind the sweet spot with the added lead weights.

This means a mis-hit shot doesn't have that weight to help it along, as it does with the peripherally weighted metal wood golf clubs. The result is a substantial drop-off in performance for shots hit off the sweet spot. For that reason, standard-sized wooden heads will do little for the golfer who fights inconsistency. The present invention corrects this problem.

Golf clubs are designed with varying degrees of loft, which range from a minimum of about 8 degrees for a number 1 wood to a maximum of a bout 29 degrees. The different degrees of loft help to control the trajectory and distance a golf ball is hit. The lower lofted clubs are used for hitting a ball long distances, with the least amount of trajectory. The higher lofted clubs are preferred for hitting the ball shorter distances with a higher trajectory. The problem with the existing clubs is that it is often difficult to obtain adequate lift in the lower lofted clubs, while in the higher lofted clubs, offshoot is a problem. These problems are corrected by this invention.

Invention, U.S. Pat. No. 5,362,055, an oversized metal wood, violates all the principles of perimeter weighting and club face thickness flexibility. The club in this patent has an insert cavity formed by support walls to accept an insert made of cycolac or an ABS resin. The insert is attached to the insert cavity with an adhesive or epoxy and a plurality of metal pins securing the insert in its cavity. The insert cavity supporting walls project rearward and perpendicular to the plane of the club face wall and forming a "U" shaped beam. The interior surface of the club face is reinforced with three ribs. This combination of insert cavity ("U" shaped beam), the epoxy, the insert and plurality of metal pins, makes for a thick and rigid face. With a rigid or stiff club face there is loss of energy during the time the ball is on the club face, and the ball deforms more. If the face was less rigid or stiff and so constructed that it would deflect a little more, the ball would deform less. The result would be a smaller loss of energy at impact and the ball would stay on the face longer, resulting in a higher launch angle and lower spin rate. This would also mean a longer carrying distance. (Reference: Golf Magazine, August 1998, page 70). Also, as you go beyond the "center" of the sweet spot to the insert cavity supporting walls, the club face becomes even more rigid. The total thickness of the club face at that point equals the thickness of the wall which the insert rests upon, plus the depth of the insert cavity supporting wall with the club face thickness, forming a "Z" section structure. This makes for an extremely rigid structural member and little club face deflection upon impact with the golf ball. At that point the ball would deform more at impact, with a loss of energy during the time the ball is on the club face. The "sweetspot" is "limited to the insert", but is defeated by its rigidity.

There has been a concern in the above patent that the primary faults of the other club heads is the thinness at the crown portion, which subsequently crumble at impact. The above patent welds a thin crown to a thin crown plate and relies upon the seam weld to strengthen the crown. The crown could be further strengthened if it had a little bit more thickness-to it. A good portion of this additional weight could be applied if the club face were redesigned to a less rigid one, and less weighty one. Eliminating the insert cavity supporting walls, insert, epoxy and the plurality of metal pins, the weight savings could be utilized for a thicker crown and thicker crown plate, and/or for various other design features. (Reference: U.S. Pat. No. 5,489,094 shows such a way to eliminate most parts, and to provide a greater sweetspot) Also, unless there are other features that could be incorporated in the club head internal cavity, the cavity opening can only be limited to the crown, face or sole portions of the club head. The above invention only provides the crown opening to cast the club head internal cavity and some ribs with no other reinforcing structure other than relying on the crown welds for strength. The present invention, although utilizing a crown opening, has a different function, purpose and result than the above invention in addition to correcting the problems and faults listed. The present invention utilizes the crown opening as the only means to add the supporting club head structure and other design features.

A metal wood and wood wood golf club with a swing-weight housing, variable swing-weights, a counterbalancing effect, and a variable (ratio) swingweight constitutes the present invention correcting the shortcomings of the traditional club heads. Metal wood club heads are hollow, cast in a variety of metal alloys, to which a hollow metal shaft is attached. The metal wood comprises an upper metal surface (the crown), a front ball striking surface (the face) which extends from the heel to the toe of the club head a lower metal surface or sole portion comprised of three distinct surfaces or contours: (1) the front portion of the sole which extends from the lower edge of the face backwards along the sole of the convex portion of the sole, (2) the rear portion of the sole which extends forward from the rear junction of the sole and crown to its junction with the convex portion of the sole, and (3) a convex surface located between the front and rear portions of the sole surface.

The hosel is located on the crown near the heel end of the club head and penetrates the crown portion as a hollow metal cylinder. The golf club shaft (a hollow shaft) is attached to the club head by penetrating through a circular opening in the center of the hosel, to a fixed depth called the "stop". Above the "stop", and centrally located between the "stop" and inner surface of the crown is an opening of sufficient diameter to permit entry of a synthetic plastic foam material. The hosel, as a hollow metal cylinder, extends from the "stop" to the uppermost surface of the "swing-weight housing". The "swing-weight housing" is a self contained housing as a cavity within the club head cavity. It has a vertical and horizontal member or plate attached to each other and forms an obtuse angle. The vertical and horizontal members are bounded and formed to the hosel (heel), toe, inner surface of the sole and inner surface of the face. This structural member serves as a reinforcement for the sole plate, face and as a beam between the heel and toe of the club head. This structural member is not available in the standard conventional club heads which can deform on impact. The horizontal member has an opening to facilitate the casting process. Upon completion of the casting process, a plate equal to the thickness of the horizontal member is welded (or brazed) to close the opening. The only and logical place to cast the "swing-weight housing" is through the crown opening since the heel, face, toe and sole are formed with it. Now, the only access to the "swing-weight housing" is through the opening in the hollow metal shaft located at the grip end. The opening is secured by a nylon plug and seal. By removing the nylon plug, we may add the swing-weights" equal to the volume of the "swing-weight housing". Once added the "swing-weights" travel on a downward path through the shaft, into the hosel extension and into the "swing-weight housing". Replacing the nylon plug and seal secures and restricts the "swing-weights" to a travel only between the grip end of the shaft and the "swing-weight housing" in the club head. Thus, on address, the "swing-weights" are in the club head. On the upswing, the "swing-weights" travel from the club head, through the hosel extension, up the hollow shaft, coming to rest in the grip end of the shaft. On the down swing the process is reversed until the combined weight of the club head and "swing-weights"

make contact with the ball. The "swing-weights" are in the grip end of the hollow shaft at the start of the downswing. Thus, the club head feels lighter making it easier to create club head speed. This feature is non-existant in the traditional and conventional clubs. (Thus, we have a "Variable Swing-weight".) The "variable swing-weights" consist of any free flowing material such as small metal balls, shot, metal filings, granules and pellets. The "swing-weights" material is made of any metal or metal alloy with a specific gravity range of 0.87 to 21.37. The "swing-weights" may also consist of dry sand or any non-toxic or acidic liquids such as free flowing oils and water with a specific gravity of 0.82 and upward. The "swing-weight" material is not limited to the above, any small free flowing material can be used.

The interior surface of the club face wall is reinforced and formed with vertical ribs. The ribs reinforce the front face allowing it to be thin and flexible, yet having the structural strength of a thicker surface. The thickness of the face wall shall have a spring-like action so as to have a trampoline effect. A loss of energy occurs whenever two objects collide. During the microseconds that a ball is on the club face, some energy is lost because the face deflects and the ball deforms. The face then, should be constructed that would deflect a little more so the ball would deform less. Further more, the ball would stay on the face microseconds longer, resulting in a higher launch angle and lower spin rate, meaning a longer carry distance. (Reference: Golf Magazine, August 1998, page 70.) This is an additional advantage to the present invention which offers a greater trajectory and distance over the traditional and conventional clubs as a result of its "swing-weight housing" and "variable swing-weights". This is in contrast to invention U.S. Pat. No. 5,362,055 which has a complex face structure consisting of "U" and "Z" beams. These beams and insert with a plurality of screws adds extra weight and rigidity to the club face contributing to the loss of energy when striking the ball. Also, the metal and weight saved by the present invention in eliminating that complex structure, is best utilized in part, in the crown area in which their major concern was a thin crown. The balance of the metal and weight saved would be utilized in the casting of the "swing-weight housing". Any additional metal required for the "swing-weight housing" could be taken from the areas requiring less metal due to its reinforcing beam structure.

The invention is further characterized by a crown opening and crown plate which is welded to it. Since the internal cavity of the club head cannot be cast without an opening, the only logical place for it would be in the crown, as, (1) it is impossible to cast the "swing-weight housing" with its cavity opening any other place because it is formed with the heel, face, toe and sole of the club head. (2) the crown opening provides an access for the welding of a plate to secure the "swing-weight housing" cavity. (3) the crown opening provides access when welding the separate vertical and horizontal plates to the heel, face, toe and sole which forms another embodiment of the "swing-weight housing". and, (4) the structural members of the "swing-weight housing" make up a beam which reinforces the heel, face toe and sole of the club head, and adds additional weight to the sole plate. The crown opening shall be kept to a minimum within practical limits to minimize the crown seam which is formed when welding the crown plate to the crown opening.

U.S. Pat. No. 5,362,055 calls for an opening at the crown having a lip or angle formed at its edge so that the crown plate fits into the opening and engages the lip or angle of the opening to support the crown plate. The lip or angle is excess metal, which could best be utilized in the crown wall thickness or as part of the present invention in the swing-weight housing.

The present invention provides better utilization of the metal used. The present invention eliminates the lip or angle in the crown opening. By forming a few small tabs on the top of the crown plate, just slightly overlapping the crown, and inserting the crown plate in the crown opening, the top surfaces of the crown plate and crown are aligned. During the welding operation these tabs could be burned off, or ground off just prior to the welding operation of each locating tab. A further smoothing or grinding operation of the weld is still required in any case. With this process precious metal is saved and utilized in the other areas as needed. Another option is to use a fixture holding the crown plate while welding to the crown.

The crown is effectively divided into three smaller sections by the crown plate seam and is therefore stronger and less flexible than a similar crown without a seam. A thicker and reinforced crown with a seam is less susceptible to crushing. Moreover we have a strengthened crown with the additional thickness from the metal and weight saved from the overly rigid club face of the invention U.S. Pat. No. 5,362,055. The balance of the weight savings may be utilized in the beam structure of the "swing-weight housing". The club head of the present invention is thus stronger than a club of equal weight, volume and material.

The preferred embodiment of the club head shell is formed of a 6AL4V titanium alloy, containing 6% aluminum, 4% vanadium, and 90% titanium, making the impact surface significantly stronger than elemental titanium. Titanium is 34–45% lighter than steel and a 17-4 stainless steel head weighing 206 grams would weigh less than 125 grams if made of titanium. Although the preferred embodiment of the club head shell is 6AL4V titanium alloy, any structurally sound metal alloy may be used such as titanium-aluminum alloy, preferably 92% aluminum and 8% titanium with some variation of the alloy composition, a 17-4 stainless steel with maraging face, a 15-5 stainless steel or even a body of pure titanium with a face of 90T-6AL-4V.

A swingweight (ratio) is defined as the distribution of weight in a golf club. Two clubs may have the same weight, but if one of them has a greater ratio of weight in the head, it will feel heavier, thus having a heavier swingweight. Conversely when there is more weight in the grip end, it makes the club feel lighter, making it easier to create club head speed. With the addition of a swing-weight housing and the variable swing-weights we now have a variable swing-weight. On the address position of the club, the swing-weights are in the club head. On the upswing, the swing-weights travel from the swing-weight housing in the club head to the hosel extension and into the hollow shaft, coming to rest at the nylon plug assembly at the grip end of the hollow shaft. Now the club head is lighter. On the downswing the process is reversed where the swing-weights travel from the grip end of the hollow shaft, coming to rest in the club head. Thus, a "Variable Swingweight". The transition of the swing-weights from the club head to the grip end of the hollow shaft provides another advantage—an "Automatic Counterbalancing" effect.

Counterbalancing is the process of reducing the club heads swingweight (ratio) by adding weight to the grip end. The transfer of the swing-weights from the club head to the grip end of the clubhead on the upswing accomplishes this, creating club head speed on the downswing. Thus an "Automatic Counterbalancing" effect.

In the present day or traditional club heads, the process of obtaining adequate lift with the lower lofted clubs and offshoot in the higher lofted clubs is corrected by the swing-weights and the swing-weight housing with a greater trajectory and distance.

Normal size drivers and fairway/utility metal woods have a thicker wall section than the oversized metal woods. This is attributed to their reduced volume and in some cases a heavier weight than the oversized club head. For the normal size drivers and fairway/utility club heads we can reduce the wall thickness in each club head for use in the casting of the swing-weight housing. Additionally, we can further reduce the wall thickness in each club head, to the wall thickness used in the oversized driver. By reducing the wall thickness still further the total weight of the swing-weight housing cast in the cavity of the club head and the club head is less than the weight of a standard driver and fairway/utility club head in each case. Now, we have a set of club heads that are lighter than the standard or conventional club heads. This reduction in weight increases club head speed with an additional trajectory and shot distance when the ball is hit, since the energy imparted to the ball is proportional to the effective mass of the club head (club head plus swing-weights on the downswing) times the square of club head velocity. With the oversized club head we only had a slight increase in club head speed due to the momentum created by the swing-weights on the down swing of the club head, plus the extra weight of the swing-weights, With the normal size drivers and fairway/utility clubs heads we have the additional speed created by a lighter club head, plus the weights of the swing-weights themselves. In using anyone of the variable swing-weights we have also changed the CG of the club head, in each of the various CG's created by various swing-weight housing configurations. Swing-weight housing also reinforces the club head.

In each of the preferred and other embodiments we have created a swing-weight housing located in the cavity of the club head. Although the swing-weight housings take on a specific configuration in each of the drawings, it is not to be construed that it may not take another configuration. By altering the heights (from the sole to the crown), and widths (from the face to the convex portion) and the shape of the swing-weight housing and its proximity to its intended function, in conjunction with the variable swing-weights, we can produce a swing-weight housing for greater backweighting, foreweighting, heel-toe weighting, and sole weighting, to mention a few, but not limited to those mentioned. In each of these swing-weight housings we have now changed the vertical and horizontal CG of the club head creating a plurality of swing-weight housings. With each change of swing-weights from a selection of the variable swing-weights we now have a plurality of CG's changing the CG's of the plurality of swing-weight housings. With each CG change of the swing-weight housings and each CG change of the variable swing-weights we may now incorporate each with the various lofted club heads.

The disadvantage of today's wood wood clubs is that they have the majority of the weight behind the sweet spot, meaning a mis-hit shot doesn't have the weight to help it along as with the peripherally weighted metal wood golf clubs. The result is a substantial drop-off in performance for shots hit off the sweet spot. For that reason standard sized wood wood heads will do little for the golfer fighting inconsistency. The present invention corrects this problem by applying the principles of the metal wood golf club to the wood wood club. By machining or carving a "swing-weight housing" and tunnel leading to the hollow shaft, and adding the "variable swing-weights" and nylon plug assembly, we have accomplished all of the principles listed in this invention.-With one exception, unless treated , we should not use any free flowing oils or water as "swing-weights". An option for the laminated woods is that the swing-weight housing cavity can be precut in each lamination prior to applying the adhesive.

Accordingly, besides the objects and advantages of my golf clubs with a "variable swingweight", "variable swing-weights", and "swing-weight housing" described in my invention, several objects and advantages of the present invention are:

(A) Solution of a long-felt and unsolved need:—This invention provides a greater trajectory and shot distance over the normal or traditional golf clubs. Normally, golfers try to increase their swing velocity by compensating for their fixed club head weight, and thus golf ball distance. By doing so, the forced swing invariably throws the golfer off balance, creating a "hook" or "slice" rather than a line drive. The heavier the club head the less swing velocity, and conversely, the lighter the club head the easier it is to create club head speed. With the present invention the golfer need only to have a normal swing for a greater shot distance and trajectory due to its unique "swing-weight housing" and "variable swing-weights".

(B) New principle of operation:—This invention utilizes a new principle of operation with its unique "variable swingweight", "swing-weight housing", "variable swing-weights" and feature of a "counterbalancing" effect. The object is to make the club head heavier with the same or, slightly greater swing velocity providing a greater trajectory and shot distance. (The energy imparted to the ball by the club is proportional to the effective mass of the club head times the square of the club head velocity.) This is accomplished by this invention utilizing its "swing-weight housing" and "variable swing-weights" previously described in detail.

(C) Unsuggested combination:—The prior art references do not contain any suggestion (expressed or implied) that the present invention may be combined.

(D) Novelty:—The invention is different from all previously know arts or counterparts, due to its "variable swingweight", "variable swing-weights", "swing-weight housing" and counterbalance effect, previously described, creating longer ball drives and trajectory with the same club head speed and increased club head weight.

(E) Durability:—The golf club will last longer due to its internal structural configuration. The "swing-weight housing" is a structural member formed with the heel, toe, face and sole of the club head, a feature not available in present day golf club heads.

(F) Unexpected results:—The results achieved by the invention are new, unexpected, superior, mismatched, unsuggested, unusual, and surprising. With a "variable swingweight", "varied swing-weights", "swing-weight housing" and a "counterbalancing" effect a golfer can expect a higher trajectory and an increased shot distance proportional to the SpGr of swing-weight used. A golfer can remove the "nylon plug and seal" securing the "swing-weights" restricted to a movement between the grip end of the shaft and "swing-weight housing", remove the original "swing-weights", and replace them with either a higher or lower SpGr "swing-weight" from a range of 0.82 to 21.37. The "swing-weight" change affects the golf balls trajectory and shot distance to a greater or lesser degree. This is accomplished using the same swing velocity and combined weight of club head plus the "variable swing-weights", since the energy imparted to the ball is the mass times the square of the velocity.

(G) Speed:—There is a slight increase in the club head speed due to the momentum of the "swing-weights" during the downward swing, which would provide a slight increase in trajectory and shot distance over the conventional or traditional clubs.

(H) Ease of use:—The invention is used as any other traditional or conventional golf clubs.

(J) Lack of implementation:—If the invention were in fact obvious, because of its many advantages, such as a "variable swingweight" (ratio), "variable swing-weights", a "swing-weight housing" which increases the structural integrity of the club head, a counterbalancing effect of the "swing-weights" since the "swing-weights" are in the grip end of the club at the start of the downswing, and the ability to have a heavier club head without affecting the swing velocity providing for a higher trajectory and shot distance, those skilled in the art surely would have implemented it by this time. That is, the fact that those skilled in the art have not implemented the invention despite its many and great advantages, indicates that it is not obvious.

The above and other features of the invention, including various novel details of construction and combination of parts, will be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the claims.

SUMMARY OF THE INVENTION

Metal wood and wood wood clubs with a "swing-weight housing" using "variable swing-weights" creating a "variable swingweight", an "automatic counterbalancing effect" and "varied center of gravity" effects in addition to an increased trajectory and shot distance to the golf ball when hit. The "swing-weights" are housed in a "swing-weight housing" within the golf club cavity. On address, the club head total weight is the "swing-weights" plus the club head with the "swing-weight housing". On the upswing the "swing-weights" travel from the "swing-weight housing" through the hosel cavity, into the hollow shaft, coming to rest in the grip end of the hollow shaft. On the downswing the "swing-weights" reverses its travel to the club head, picking up momentum and slightly increasing club head speed. The velocity of the club head plus the combined weights of the "swing-weights" and club head, gives a greater trajectory and shot distance when the ball is hit, since the energy imparted to the ball is proportional to the effective mass of the club head times the square of the club head velocity.

OBJECTS OF THE INVENTION

An object of the invention is to provide a golf club with a low center of gravity (CG) by keeping the swing-weight housing and swing-weights low to the sole which gets the ball up by adding loft (lift) to the club during the swing and at impact. With each change of the variable swing-weights there is a CG change in the golf club.

A further object of the invention is to provide a golf club with varying degrees of a high trajectory shot by varying the distance of the swing-weight housing and swing-weights from the club face to the convex portion, while still maintaining its original volume. With each change of the variable swing-weights, there is a CG change in the golf club.

A further object of the invention is to provide a golf club with varying degrees of a high center of gravity on the vertical axis by varying the height of the swing-weight housing with the swing-weights closer to the inner crown surface, reducing its width, while maintaining its original volume, thus creating a lower trajectory shot. With each change of the variable swing-weights there is a CG change in the golf club.

A further object is to provide a removable nylon plug and seal at the grip end of the hollow shaft so as to either add or exchange the "swing-weights".

A further object is to alter the trajectory and distance of the golf ball when hit by the club, by exchanging the original "swing-weights" SpGr with either an increase or decrease in the "swing-weights" SpGr and in the same volume.

A further object of the invention is to provide an "Automatic Counterbalancing" effect, reducing the club's swing-weight" by adding weight to the grip end of the club.

A further object of the invention is to provide such a club configured together with the "swing-weights" and its "swing-weight housing" so as to place the center of gravity proximate the geometric center of the club head center of gravity.

A further object of the invention is to provide a golf club in which the center of gravity of the club in combination with the "swing-weights" and its "swing-weight housing" is positioned at the optimum location in the club.

A further object of the invention is to provide a golf club in which the center of gravity of the club in combination with the "swing-weights" and its "swing-weight housing" is positioned at the optimum location for the various lofted clubs.

A further object of the invention is to improve the lift of the lower lofted clubs.

A further object of the invention is to decrease the weight of the standard drivers and fairway metal woods while maintaining rigidity with the swing-weight housing to increase club head speed.

A further object of the invention is to decrease the weight of the standard drivers and fairway metal woods while maintaining rigidity with the swing-weight housing, in conjunction with each of the variable swing-weights to increase the club head speed, trajectory and distance when the golf ball is hit.

A further object of the invention is to decrease the weight of the standard drivers and fairway metal woods, in conjunction with each of the variable swing-weights, and in conjunction with the range of the various lofted club heads to increase club head speed providing a variety of trajectories and distances when the golf ball is hit, and in each case a change in the CG of the club head.

A further object of the invention is to provide a plurality of swing-weight housings by varying its height and width, while maintaining its volume, and in doing so, varying the vertical and horizontal centers of gravity in each case of the club head.

A further object of the invention is to provide a plurality of swing-weight housings by varying its height and width, while maintaining its volume and varying the vertical and horizontal centers of gravity in conjunction with each of the variable swing-weights creating an additional plurality of CG's of the club head.

A further object of the invention is to provide a plurality of swing-weight housing CG's with a plurality of each of the variable swing-weights, with each of the lofted club heads.

BRIEF DESCRIPTION OF THE DRAWINGS

These and other objects of the present invention will become apparent when considered in light of the following illustrations, wherein:

FIG. 1 is a front elevation, external view of a metal wood golf club in accordance with a preferred embodiment of the present invention, showing the head and lower portion of the shaft;

FIG. 2 is a side elevation view of the golf club shown in FIG. 1;

FIG. 3 is a top view of the golf club shown in FIG. 1 with the crown welded in the crown opening;

FIG. 4 is a top view of the grip end of the shaft showing the nylon plug and grip;

FIG. 4A is a cross section view of FIG. 4, showing the grip, nylon plug, seal, retainer (screw) and tapped hole;

FIG. 9 is another embodiment of FIG. 5 with a cutaway view showing the swing-weight housing offset from the inner surface of the front face with reinforcing ribs, and view with crown opening and crown plate omitted;

FIG. 10 is a top view of a plate to be welded to the swing-weight housing;

FIG. 11 is a cross section of FIG. 9 showing the swing-weight housing, its cavity, the swing-weights, and hosel extension.

FIG. 12 is a cross section of FIG. 9 showing the interior surface of the front face of the golf club, the reinforcement ribs, hosel extension and swing-weight housing;

FIG. 17 is another embodiment of FIG. 5 with a cutaway view showing the swing-weight housing detached from the inner surface of the front face with reinforcing ribs and view with crown opening and crown plate omitted. This view shows a heel-toe weighting with its bow or inverted "B" shaped swing-weight housing configuration;

FIG. 18 is a top view of a plate to be welded to the swing-weight housing;

FIG. 19 is a cross section of FIG. 17 showing the swing-weight housing, its cavity, the swing-weights and hosel extension; and FIG. 20 is a cross section of FIG. 17 showing the interior surface of the front face of the golf club, the reinforcing ribs, the hosel extension and swing-weight housing.

DETAILED DESCRIPTION OF THE DRAWINGS

Figure 5:
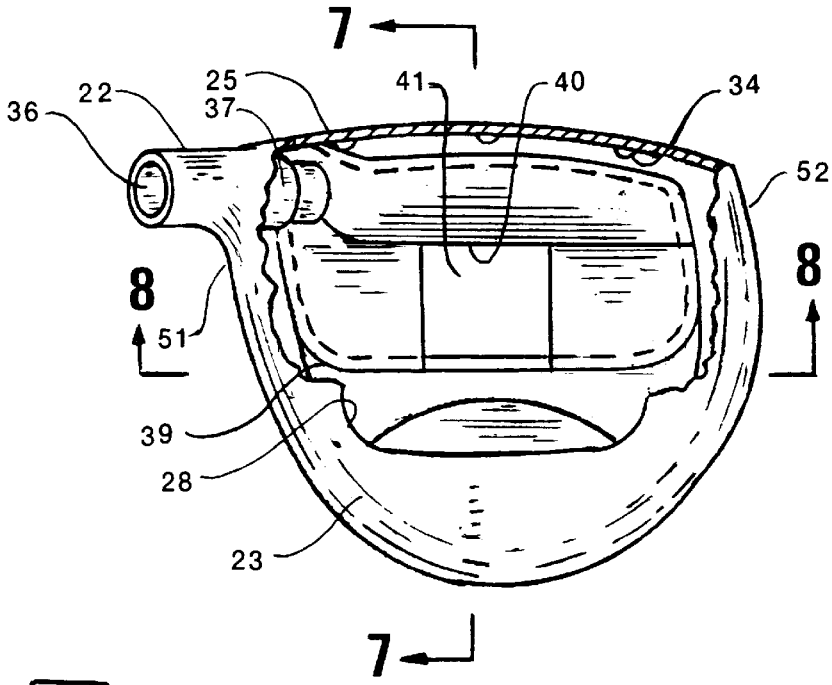
FIG. 5 is a top view of a golf club shown in FIG. 1 with a cutaway view showing the swing-weight housing offset from the inner surface of the front face, with reinforcing ribs, and view with crown opening and crown plate omitted.

Referring to FIG. 1, a golf club head 20 in accordance with a preferred embodiment of the invention is shown. FIG. 1 shows the golf club head 20 with a hollow shaft 21 attached to the club head 20 by inserting the hollow shaft 21 into hosel 22 so that the shaft penetrates the interior of the club head 20, The club head 20 as shown in FIG. 1 comprises a hollow metal shell which is filled with a foam or packing crystals. In a preferred embodiment the metal head is filled with expandable crystals which may be weighed precisely to account for variances in the overall weight of the molded head piece 20. This process or technique reduces the number of heads that may be rejected due to weight variances.

The extremity of club head 20 is comprised of a crown 23, a concave surface 30, sole 24, and a club face 25. The club face 25 is machined to form horizontal face grooves 26. In the preferred embodiment it is preferable to machine the face grooves 26 to maintain control of the spacing, depth, width and corners of the horizontal face grooves 26.

Referring to FIG. 2, in the preferred embodiment, the club head 20 extremity is cast in a single piece forming club face 25, a sole 24, a crown 23 with a crown opening 28 formed in the crown. The crown opening 28 is filled by a crown plate 27. The crown plate 27 is secured to crown 23 by welding. In the preferred embodiment the crown plate 27 is welded to crown 23 to fill the crown opening 28 formed in the crown 23. This welding forms a reinforcing seam 29 in the crown at the juncture of the crown plate 27 with crown 23. In the preferred embodiment, the crown plate 27 is formed with a few small tabs located circumferential at the top of the crown plate 27, just slightly overlapping the crown 23. When the crown plate 27 is inserted in the crown opening 28, the top surfaces of the crown plate 27 and crown 23 are aligned. During the welding operation these tabs could be burned off, or ground off just prior to the welding operation of each locating tab. A further smoothing or grinding operation of the weld seam is still required in any case. Another option would be a holding fixture, holding the crown plate 27 and aligning it with the crown 23 to facilitate the welding operation. A top view of the crown plate 27 secured in the crown 23 is shown in FIG. 3. The solid and dashed line 29 in FIG. 3 shows the location of the weld seam. A top view of the crown 23 and opening 28 in the crown is shown in FIG. 5.

The rear portion of the sole 24 at the end opposite the face adjoins a concave surface 30. This concave aerodynamic surface 30 reduces the turbulence generated by the club head 20 as it passes through the air during the golf swing. The concave surface 30 reduces the aerodynamic drag of the club head 20 as it passes through the air and also reduces the amount of lift generated by air passing swiftly over the convex crown 30 of the club head. The reduction of lift and drag helps maintain the loft angle of the club head shown by the angle alpha in FIG. 2. The aerodynamic forces exerted on the club can cause the head to deflect. This deflection increases the deflection angle alpha and loft of club. This increase is undesirable as it reduces the distance the ball travels because energy is wasted by projecting the ball in a higher trajectory than desired.

In a preferred embodiment a crown plate 27 is located centrally in the crown 23 as shown in FIG. 3. However,the location of the crown opening 28 in the crown 23 and the location of the crown plate 27 that fills the opening may vary. The location and shape of the crown opening 28 and crown plate 27 may be adjusted to any configuration or location on the crown 23 to facilitate and permit casting the "swing-weight housing" 39 shown in FIG. 5 and the welding of cover plate 43 to it.

In a preferred embodiment there is a nylon plug assembly or seal, inserted into the opening at the grip end of hollow shaft 21. FIG. 4 is a front elevation view showing the nylon plug 44 and grip 49. A cross section of the nylon plug assembly is shown in FIG. 4A. showing how the nylon plug assembly is fastened to hollow shaft 21. The nylon plug 44 has a circumferential groove machined at one end to accept a seal 48 which outside diameter is slightly larger than the diameter of the nylon plug 44 entering the hollow shaft 21. The nylon plug 44 and seal 48 forms the nylon plug assembly. The inner diameter of hollow shaft 21 is smaller than the outside diameter of the seal 48. Therefore, as the nylon plug assembly is inserted into hollow shaft 21, the seal 48 is compressed against the inner diameter of hollow shaft 21. The compression of seal 48 against the inner diameter of hollow shaft 21 makes it secure against any leakage of liquids or particulate matter of any type within the hollow shaft 21. The nylon plug has a tapped hole 47 with imperfect threads part way through. Nylon has a memory and has a tendency to exert a pressure against any object that is forced into it. As the screw or fastener 46 is inserted and threaded into tapped hole 47 and into the imperfect threads a force is created around the screw 46 holding it and preventing it from loosening, other than by mechanical means. The nylon plug 44 has a hole 45 used as a pull to remove the nylon plug 44 from the hollow shaft 21. Hollow shaft 21 has a hole 55 to permit entry of screw 46 into the nylon plug 44 and securing it to the hollow shaft 21. The grip 49 has a clearance hole 56 to permit entry of the screw 46, into the shaft hole 55 and nylon plug 44.

Figure 7:
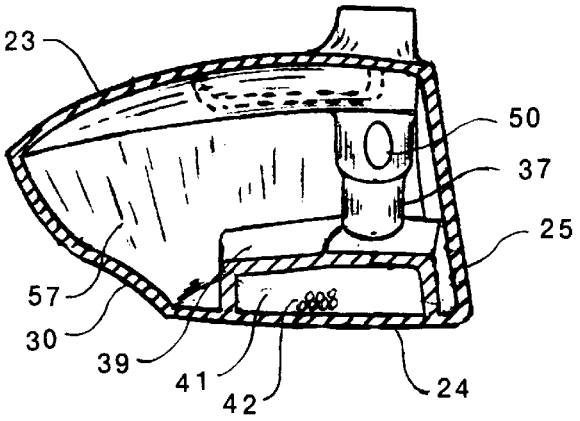
FIG. 7 is a cross section of FIG. 5 showing the swing-weight housing, its cavity, the swing-weights and hosel extension.
Figure 8:
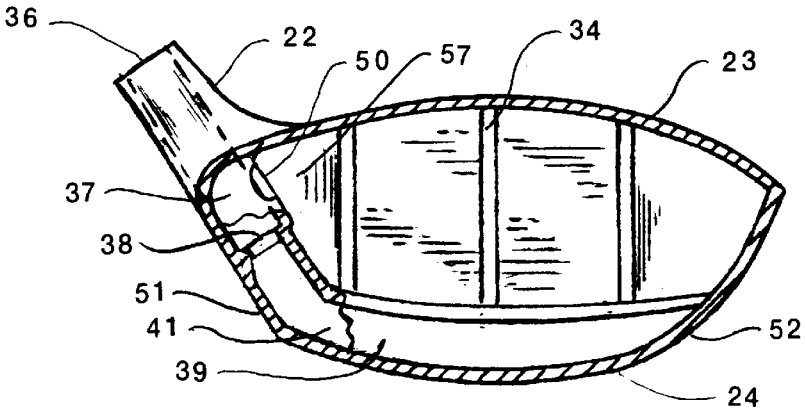
FIG. 8 is a cross section of FIG. 5 showing the interior surface of the front face of the golf club, the reinforcing ribs, hosel extension and swing-weight housing.

Referring to FIG. 5, FIG. 7 and FIG. 8 in a preferred embodiment, the club head 20 is cast in a single piece forming the extremities of club head 20 to include a club face 25, sole 24, crown opening 28 in crown 23, concave surface 30 and in the club head cavity 57 of the club head 20, a swing-weight housing 39 with its swing-weight housing cavity 41 connected to a hosel extension 37 with opening 50 and extending outwardly to the hosel 22.

FIG. 5, FIG. 6, FIG. 7 and FIG. 8 are described in detail below clarifying the casting construction.

Figure 6:
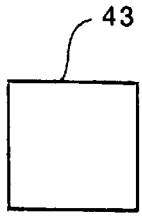
FIG. 6 is a top view of the plate to be welded to the swing-weight housing.

FIG. 5 in a preferred embodiment shows the top view of a golf club cutting away a portion of the crown 23 and crown opening 28 showing the reinforcing ribs 34 of the inner surface of club face 25, and a swing-weight housing 39 with its opening 40 to permit casting of the swing-weight housing cavity 41. The opening 40 is subsequently closed by welding cover plate 43 (as shown in FIG. 6) peripherally to it so as to enclose the cavity 41 and preventing leakage of swing-weights 42 (shown in FIG. 7). The only access to the swing weight housing 39 after welding cover plate 43 is through bore 36 of hosel 22. The swing-weight housing 39 is formed together with the inner surface of the sole , hosel extension 37 heel 51 and toe 52 creating a structural member reinforcing club head 20. The swing-weight housing 39 is detached from the inner surface of the club face 25 with a minimum amount of clearance from the reinforcing ribs 34 sufficient to perform the casting operation. The interior surface of the club face wall is reinforced and formed with vertical ribs. The ribs reinforce the club face 25 allowing it to be thin and flexible, yet have the structural strength of a thicker surface. The thickness of the club face wall shall have a spring like action so as to have a trampoline effect. (Ref.: USGA, GOLF MAGAZINE 1998)

Referring to FIG. 7 in the preferred embodiment is a cross section view of club head 20, showing the swing-weight housing 39 in cavity 57, formed to the inner surface of sole 24 and hosel extension 37 with opening 50. The swing-weight housing 39 has a cavity 41 which houses the swing-weights 42 equal to the volume of the cavity 41. The horizontal plate of the swing-weight housing 39 is formed as an obtuse angle so that on the upswing of the club the swing-weights 42 follow a trough like depression leading to the cavity of the hosel extension 37. The wall thickness of the horizontal and vertical plates of the swing-weight housing 39 shall be as thin as possible within the practical casting limits, while still maintaining a leak proof housing. The height of the swing-weight housing 39, from the sole 24 to the crown 23 and the distance from the face 25 to the convex portion 30 may vary, while still maintaining the same volume. In doing so the center of gravity (CG) of the club head 20 will also vary. With each variation of the height and width of swing-weight housing 39, the form could take the shape as in FIG. 9, FIG. 11 and FIG. 12, and with each variation, increasing the vertical center of gravity (CG) of the club head. Also, by moving the swing-weight housing 39, closer to the convex portion 30, while still maintaining its configuration, the horizontal center of gravity changes promoting a higher trajectory shot. With each change of the swing-weights 42 specific gravity (SpGr), the CG of the club head 20 changes as well. The FIG. 7 cross section shows how the swing-weight housing 39 creates a structural member reinforcing club head 20. FIG. 5, FIG. 7, and FIG. 8 shows a low center of gravity in club head 20.

Referring to FIG. 8 in the preferred embodiment is a cross section plan view of FIG. 5. Hosel 22 with its shaft bore 36 penetrates the crown wall as the hosel extension 37 with the continuation of the shaft bore 36 to stop 38. The hosel extension 37 as a hollow metal cylinder continues beyond the stop 38 forming with the swing-weight housing 39 and the swing-weight cavity 41. Centrally located between the inner surface of the crown wall and stop 38 of hosel extension 37 is opening 50 of sufficient diameter to permit entry of a synthetic plastic foam material into the club head cavity 57 prior to the assembly of hollow shaft 21 with the nylon plug assembly as shown in FIG. 4 and FIG. 4A. Reinforcing ribs 34 are formed on the inner surface of club face 25 extending from the inner surface of crown 23 to the inner surface of sole 24. Reinforcing ribs 34 are rounded in shape with its width and height to fall within standard casting practices to eliminate hot spots during the cooling process. FIG. 8 is another view showing how the swing-weight housing 39 forms with the heel 51, toe 52, inner surface of sole 24, creating a structural member reinforcing club head 20. After entry of a synthetic plastic foam material from opening 50 of the hosel extension 37, the hollow shaft 21 (shown in FIG. 1) is inserted into the shaft bore 36 to stop 38 and is secured by an epoxy or other adhesive means. (With the nylon plug assembly, as shown in FIG. 4 and FIG. 4A, assembled to the hollow shaft 21, the swing-weights 42 are now restricted to a path of the swing-weight housing 39 to the hosel extension 37, and into the hollow shaft 21.)

Referring to another embodiment, we maintain the configuration of club head 20 as shown in FIG. 1, FIG. 2, FIG. 3, FIG. 4, and FIG. 4A and to include the descriptions of their drawings, only changing the configuration of the swing-weight housing within cavity 57.

FIG. 9, FIG. 11 and FIG. 12 is another embodiment of club head 20 cast in a single piece forming the extremities of club head 20 to include a club face 25, sole 24, crown opening 28 in crown 23, concave surface 30 and in the club head cavity 57, a swing-weight housing 65 with its swing-weight housing cavity 67 connected to a hosel extension 37 with opening 50 and extending outwardly to hosel 22.

FIG. 9, FIG. 11, and FIG. 12 are described in detail below clarifying the casting construction.

FIG. 9 in another embodiment shows the top view of a golf club cutting away a portion of crown 23 and crown opening 28 showing the reinforcing ribs 34 of the inner surface of club face 25, and the swing-weight housing 65 detached from the inner surface of club face 25 with a minimum amount of clearance from the reinforcing ribs 34 sufficient to perform the casting operation. Swing-weight housing 65 has an opening 66 to permit casting of swing-weight housing cavity 67. The opening 66 is subsequently closed by welding cover plate 68 (shown in FIG. 10) peripherally to it so as to enclose the cavity 67 and preventing leakage of the swing-weights 42 (shown in FIG. 11). The only access to the swingweight housing 65 after welding cover plate 68 is through the bore 36 of hosel 22. The swing-weight housing 65 is formed with the inner surface of sole 24, hosel extension 37, heel 51, and toe 52 creating a structural member reinforcing club head 20. The interior surface of the club face wall is reinforced and formed with vertical ribs 34. The ribs reinforce the club face 25 allowing it to be thin and flexible, yet have the structural strength of a thicker surface. The thickness of the club face wall shall have a spring like action so as to have a trampoline effect.

FIG. 11 in another embodiment is a cross section view of FIG. 9 showing the swing-weight housing 65 in cavity 57 formed to the inner surface of sole 24 and hosel extension 37 with opening 50. The swing-weight housing 65 has a cavity 67 which houses the swing-weights 42 equal to the volume of the cavity 67. The horizontal plate of the swing-weight housing 65 is formed as an obtuse angle so that on the upswing of the club the swing-weights 42 follow a trough like depression leading to the cavity of the hosel extension 37. The wall thickness of the horizontal and vertical plates of the swing-weight housing 65 shall be as thin as possible within practical casting limits, while maintaining a leak proof housing. The swing-weight housing has a narrow configuration extending from the inner surface of sole 24 upwards towards the inner surface of crown 23, producing a higher vertical center of gravity. The height and width of the swing-weight housing 65 may vary while still maintaining the same volume. In doing so, the vertical center of gravity (CG) of the club head 20 will also vary. With each change of the specific gravity of swing-weights 42 the center of gravity (CG) of the club head 20 changes.

FIG. 12 in another embodiment is a cross section plan view of FIG. 9. Hosel 22 with its shaft bore 36 penetrates the crown wall as the hosel extension 37 with the continuation of shaft bore 36 to stop 38. The hosel extension 37 as a hollow metal cylinder continues beyond the stop 38 forming with the swing-weight housing 65 and the swing-weight cavity 67. Centrally located between the inner surface of crown 23 and stop 38 of hosel extension 37 is a opening 50 of sufficient diameter to permit entry of a synthetic plastic foam material into the club head cavity 57 prior to the assembly of the hollow shaft 21 (shown inn FIG. 1) with the nylon plug assembly as shown in FIG. 4 and FIG. 4A. Reinforcing ribs 34 are formed on the inner surface of club face 25 extending from inner surface of crown 23 to inner surface of sole 24. The reinforcing ribs 34 are rounded in shape with its width and height to fall within standard casting practices so as to eliminate hot spots during the cooling process. FIG. 12 is another view showing how the swing-weight housing forms with the heel 51, toe 52, inner surface of sole 24 creating a structural member reinforcing club head 20. After entry of a synthetic plastic foam material from opening 50 of the hosel extension 37, the hollow shaft 21 (shown in FIG. 1) is inserted into the shaft bore 36 to stop 38 and is secured by epoxy or other adhesive means. (With the nylon plug assembly, as shown in FIG. 4 and FIG. 4A, assembled to the hollow shaft 21, the swing-weights 42 are now restricted to a path of the swing-weight housing 65 to the hosel extension 37, and into the hollow shaft 21.)

Referring to another embodiment, we maintain the configuration of the club head 20 as shown in FIG. 1, FIG. 2, FIG. 3, FIG. 4 and FIG. 4A, and to include the descriptions of their drawings, only changing the configuration of the swing-weight housing 60 within cavity 57.

Referring to FIG. 13, FIG. 14, FIG. 15, and FIG. 16 in another embodiment, the club head 20 is cast in a single piece forming the extremities of club head 20 to include a club face 25, sole 24, crown opening 28 in crown 23, concave surface 30 and in the club head cavity 57 of the club head 20, a swing-weight housing 60 with its swing-weight housing cavity 62 connected to a hosel extension 37 with opening 50 and extending outwardly to the hosel 22.

Figure 13:
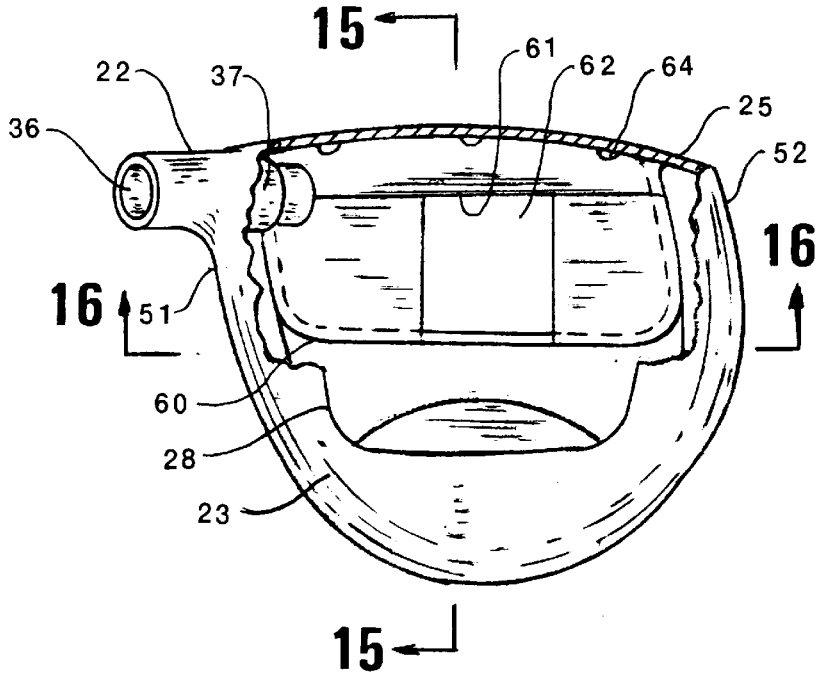
FIG. 13 is another embodiment of FIG. 5 with a cutaway view showing the swing-weight housing attached to the inner surface of the front face with reinforcing ribs and view with crown opening and crown plate omitted.
Figure 15:
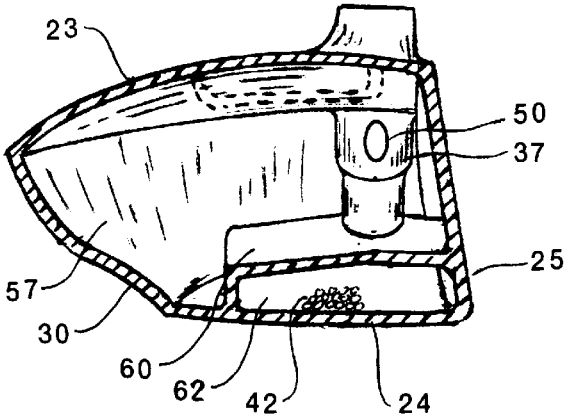
FIG. 15 is a cross section of FIG. 13 showing the swing-weight housing, its cavity, the swing-weights and hosel extension.
Figure 14:
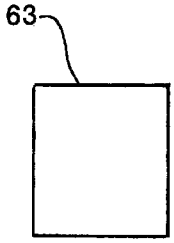
FIG. 14 is a top view of a plate to be welded to the swing-weight housing.
Figure 16:
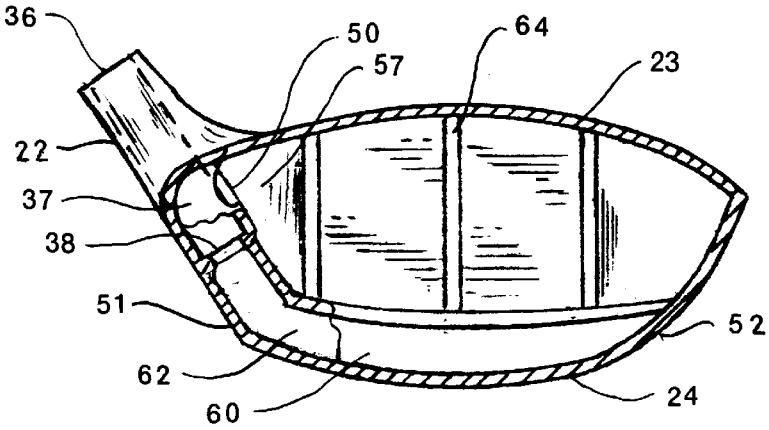
FIG. 16 is a cross section of FIG. 13 showing the interior surface of the front face of the golf club, the reinforcing ribs, hosel extension and swing-weight housing.

FIG. 13, FIG. 15, FIG. 16, are described in detail below clarifying the casting construction.

FIG. 13 in another embodiment shows the top view of a golf club cutting away a portion of the crown 23 and crown opening 28 showing the reinforcing ribs 64 of the inner surface of club face 25, and a swing-weight housing 60 with its opening 61 to permit casting of the swing-weight housing cavity 62. The opening is subsequently closed by welding cover plate 63 (shown in FIG. 14) peripherally to it so as to enclose the cavity 62 and preventing leakage of swing-weights 42 (shown in FIG. 15). The only access to the swing-weight housing 60 after welding cover plate 63 is through bore 36 of hosel 22. The swing-weight housing 60 is formed with the inner surface of face 25, inner surface of sole 24, hosel extension 37, heel 51 and toe 52, creating a structural member reinforcing club head 20. The interior surface of the club face wall is reinforced and formed with vertical ribs 64. The ribs reinforce the front face allowing it to be thin and flexible, yet have the structural strength of a thicker surface. The thickness of the face wall shall have a spring-like action so as to have a trampoline effect.

Referring to FIG. 15 in another embodiment is a cross section view of club head 20, showing swing-weight housing 60 in cavity 57 formed to the inner surface of face 25, inner surface of sole 24, hosel extension 37 with opening 50. The swing-weight housing 60 has a cavity 62 which houses swing-weights 42 equal to the volume of cavity 62. The horizontal plate of the swing-weight housing 60 is formed as an obtuse angle, so that on the upswing of the club head 20, the swing-weights 42 follow a trough like depression formed by the obtuse angle leading to the cavity of the hosel extension 37. The wall thickness of the horizontal and vertical plates of the swing-weight housing 60 shall be as thin as practical within casting limits, while maintaining a leak proof housing. The height of the swing-weight housing 60, from sole 24 to the crown 23, and the distance from the face 25 to the convex portion 30 may vary, still maintaining the same volume. In doing so, the horizontal and vertical center of gravity (CG) of club head 20 will also vary. With each change of the specific gravity (SpGr) of the swing-weights 42, the CG of club head 20 changes as well. The FIG. 15 cross section shows how the swing-weight housing 60 creates the structural member reinforcing club head 20.

Referring to FIG. 16 in another embodiment is a cross section plan view of FIG. 13. Hosel 22 with its shaft bore 36 penetrates the crown wall as the hosel extension 37 with the continuation of the shaft bore 36 to stop 38. The hosel extension 37 as a hollow metal cylinder continues beyond stop 38 forming with the swing-weight housing 60 and swing-weight housing cavity 62. Centrally located between the inner surface of the crown 23 and stop 38 of hosel extension 37 is opening 50 of sufficient diameter to permit entry of a synthetic plastic foam material into the club head cavity 57 prior to the assembly of hollow shaft 21 (shown in FIG. 1) with the nylon plug assembly as shown in FIG. 4 and FIG. 4A. Vertical ribs 64 are formed on the inner surface of club face 25 extending from the inner surface of crown 23 to the outer surface of the swing-weight housing 60. The vertical ribs 64 are rounded in shape with its width and height to fall within standard casting practices so as to eliminate hot spots during the cooling process. FIG. 16 is another view showing how the swing-weight housing 60 forms with the heel 51, toe 52, inner surface of club face 25 and inner surface of sole 24, creating a structural member reinforcing club head 20. After entry of the synthetic plastic foam material into cavity 57, the hollow shaft 21 (shown in FIG. 1) is inserted into the shaft bore 36 to stop 38 and is secured by an epoxy or other adhesive means. (With the nylon plug assembly as shown in FIG.4 and FIG. 4A assembled to the hollow shaft 21, the swing-weights 42 are now restricted to a path of the swing-weight housing 60 to the hosel extension 37, and into hollow shaft 21.)

Referring to another embodiment, we maintain the configuration of club head 20 as shown in FIG. 1, FIG. 2, FIG. 3, FIG. 4, and FIG. 4A and to include the descriptions of their drawings, only changing the configuration of the swing-weight housing within cavity 57.

FIG. 17, FIG. 19, and FIG. 20 is another embodiment of club head 20 cast in a single piece forming the extremities of club head 20 to include a club face 25, sole 24, crown opening 28 in crown 23, concave surface 30 and in the club head cavity 57, a swing-weight housing 69 with its swing-weight cavity 71 connected to a hosel extension 37 with opening 50 and extending outwardly to hosel 22.

FIG. 17, FIG. 19, and FIG. 20 are described in detail below clarifying the casting construction.

FIG. 17 in another embodiment shows the top view of a golf club cutting away a portion of crown 23 and crown opening 28 showing the reinforcing ribs 34 of the inner surface of club face 25, and the swing-weight housing 69 detached from the inner surface of club face 25 with a minimum amount of clearance from the reinforcing ribs 34 sufficient to perform the casting operation. Swing-weight housing 69 has an opening 70 to permit casting of the swing-weight housing cavity 71. The opening 70 is subsequently closed by welding cover plate 72 (shown in FIG. 18) peripherally to it so as to enclose the cavity 71 and preventing leakage of the swing-weights 42 (shown in FIG. 19). The only access to the swingweight housing 69 after welding cover plate 72 is through the bore 36 of hosel 22. The swing-weight housing 69 is formed with the inner surface of sole 24, hosel extension 37, heel 51, and toe 52 creating a structural member reinforcing club head 20. The interior surface of the club face wall is reinforced and formed with vertical ribs 34. The ribs reinforce the club face 25 allowing it to be thin and flexible, yet have the structural strength of a thicker surface. The thickness of the club face wall shall have a spring like action so as to have a trampoline effect.

FIG. 19, in another embodiment is a cross section view of FIG. 17, showing the swing-weight housing 69 in cavity 57 formed to the inner surface of sole 24 and hosel extension 37 with opening 50. The swing-weight housing 69 has a cavity 71 which houses the swing-weights 42 equal to the volume of the cavity 71. The horizontal plate of the swing-weight housing 69 is formed as an obtuse angle so that on the upswing of the club the swing-weights follow a trough like depression leading to the cavity of the hosel extension 37. The wall thickness of the horizontal and vertical plates of the swing-weight housing 69 shall be as thin as possible within practical casting limits, while maintaining a leak proof housing. The swing-weight housing has a narrow configuration extending from the inner surface of sole 24 upwards towards the inner surface of crown 23, producing a higher vertical center of gravity. The height and width of the swing-weight housing 69 may vary while still maintaining the same volume, retaining its shape as a "bow" or an inverted "B". The purpose of maintaining its shape is for "heel-toe weighting". In changing the height and width the vertical center of gravity (CG) of the club head 20 will also vary. With each change of the specific gravity of the swing-weights 42, the center of gravity of the club head 20 changes.

FIG. 20 in another embodiment is a cross section plan view of FIG. 17. Hosel 22 with its shaft bore 36 penetrates the crown wall as the hosel extension 37 with the continuation of shaft bore 36 to stop 38. The hosel extension 37 as a hollow metal cylinder continues beyond the stop 38 forming with the swing-weight housing 69 and the swing-weight cavity 71. Centrally located between the inner surface of crown wall and stop 38 of hosel extension 37 is an opening 50 of sufficient diameter to permit entry of a synthetic plastic foam material into the club head cavity 57 prior to the assembly of hollow shaft 21 (shown in FIG. 1) with the nylon plug assembly shown in FIG. 4 and FIG. 4A. Reinforcing ribs 34 are formed on the inner surface of club face 25 extending from inner surface of crown 23 to inner surface of sole 24. The reinforcing ribs 34 are rounded in shape with its width and height to fall within standard casting practices so as to eliminate hot spots during the cooling process. FIG. 20 is another view showing how the swing-weight housing forms with the heel 51, toe 52, inner surface of sole 24 creating a structural member reinforcing club head 20. After entry of a synthetic plastic foam material from opening 50 of hosel extension 37, the hollow shaft 21 (shown in FIG. 1) is inserted into the shaft bore 36 to stop 38 and is secured by epoxy or other adhesive means. (With the nylon plug assembly as shown in FIG.4 and FIG. 4A assembled to the hollow shaft 21, the swing-weights 42 are now restricted to a path of the swing-weight housing 69 to the hosel extension 37, and into the hollow shaft 21.)

In a preferred and other embodiments, the club head 20 is formed of a 66AL4V titanium alloy containing 6% aluminum, 4% vanadium, and 90% titanium, making the impact surface significantly stronger than elemental titanium. Titanium is 34–45% lighter than steel and a 17-4 stainless steel head weighing 206 grams would weigh less than 125 grams if made of titanium. Although the preferred embodiment of the club head shell is 6AL4V titanium alloy, any structurally sound metal alloy may be used such as titanium-aluminum alloy, preferably 92% aluminum and 8% titanium with some variation of the alloy composition, a 17-4 stainless steel with maraging face, a 15-5 stainless steel or even a body of pure titanium with a face of 90T-6AL-4V. Additionally, the club head could be of a solid material such as plastic, graphite or wood, with the swing-weight housing carved from such solid material forming the club head in accordance with the teachings heretofore set forth.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and there is no intention to exclude any equivalents thereof. Hence, it is recognized that various modifications are possible within the scope of the present invention as claimed.

I claim:

1. A swing weight assembly for a golf club, wherein said golf club is defined by a club head having a face, sole crown, heel and toe, and further having a tubular hosel positioned in said crown proximate said heel and extending into said club head for receipt of a first end of a hollow shaft, said hollow shaft having an opposing handle end, the swing weight assembly comprising:

a housing for adjusting the center of gravity of said club head, said housing positioned in said club head rearwardly from the face of the club head, said housing defining a chamber, said chamber being defined by a front wall set back from the face of said club head, a top wall, a rear wall, and the sole of said club head, said chamber extending transversely from the toe of the club head to the heel of the club head, and vertically from said sole of said club head;

a means for communication from said chamber of said housing to said hosel and to said shaft;

a sealing means secured in said shaft proximate the handle end of said shaft;

a flowable weighted material, said flowable weighted material positioned in said chamber and filling said chamber of said housing when said club head is positioned in an address position for striking a golf ball, said flowable weighted material displaced from said chamber through said tubular hosel into said shaft of said golf club proximate said sealing means when said golf club head is disposed in the back swing of a golf swing, said flowable weighted material returning to said chamber of said housing by means of said shaft and said tubular hosel when said club head is in the downswing of said golf swing prior to impacting said golf ball.

2. The swing weight assembly in accordance with claim 1 wherein said flowable weighted material is a fluid having a minimum specific gravity of 0.82.

3. The swing weight assembly in accordance with claim 1 wherein said flowable weighted material is comprised of a particulate matter having a maximum a specific gravity of 21.37.

4. The swing weight assembly in accordance with claim 1 wherein the vertical height of said housing effects the location of the vertical center of gravity of said club head.

5. The swing weight assembly in accordance with claim 1 wherein the depth of said housing from said face of said club head to the rear of said club head effects the horizontal center of gravity of said club head.

6. The swing weight assembly in accordance with claim 1 wherein said means for communication from said chamber of said swing weight housing to said hosel is an aperture formed in said housing in alignment with and securable to said hosel extension into said club head.

7. The swing weight assembly in accordance with claim 1 wherein said means for communication of said chamber of said swing weight housing to said hosel is a tubular hosel extension secured to said swing weight housing proximate said heel of said golf club head and secured to said tubular hosel extending into said club head providing means for communication from said chamber of said swing weight housing to said hosel and to said shaft.

8. A golf club incorporating a swing weight assembly for variably altering the swing weight and counterbalancing of the golf club during the golf swing comprising:

a golf club having a club head having a ball striking face, a sole, a crown, a heel, and a toe, said golf club further defined by a tubular hosel positioned in said crown proximate said heel and extending into said club head, said tubular hosel for receipt of a first end of a hollow shaft, said hollow shaft having an opposing handle end;

a housing for adjusting the center of gravity of said club head, said housing positioned in said golf club head rearwardly from said face of said club head and extending transversely from said toe of said club head to said heel of said club head and vertically from said sole of said club head, said housing defining a chamber, said chamber being defined by a front wall set back from said face of said club, a top wall, a rear wall and said sole of said club.

a means for communication from said chamber of said housing to said hosel and to said shaft;

a sealing means secured in said shaft proximate said handle end of said shaft;

a flowable weighted material, said flowable weighted material positioned in said chamber of said housing and filling said chamber of said housing when said club head is positioned in an address position for striking a golf ball, said flowable weighted material displaced from said chamber through said tubular hosel into said shaft of said golf club proximate said sealing means when said golf club head is disposed in the back swing of a golf swing, said flowable weighted material redisplaced to said chamber of said housing by means of said shaft and said tubular hosel when said club head is in the down swing of said golf swing prior to impacting said golf ball.

9. The swing weight assembly in accordance with claim 8 wherein said flowable weighted material is a fluid having a minimum specific gravity of 0.82.

10. The swing weight assembly in accordance with claim 8 wherein said flowable weighted material is comprised of a particulate matter having a maximum specific gravity of 21.37.

11. The swing weight assembly in accordance with claim 8 wherein the vertical height of said housing effects the location of the vertical center of gravity of said club head.

12. The swing weight assembly in accordance with claim 8 wherein the depth of said housing from said face of said club head to the rear of said club head effects the horizontal center of gravity of said club head.

13. The swing weight assembly in accordance with claim 8 wherein said means for communication from said chamber of said swing weight housing to said hosel is an aperture formed in said housing in alignment with and securable to said hosel extension into said club head.

14. The swing weight assembly in accordance with claim 8 wherein said means for communication of said chamber of said swing weight housing to said hosel is a tubular hosel extension secured to said swing weight housing proximate said heel of said golf club head and secured to said tubular hosel extending into said club head providing means for communication from said chamber of said swing weight housing to said hosel and to said shaft.

* * * * *